US007048624B2

(12) United States Patent
Pardini

(10) Patent No.: US 7,048,624 B2
(45) Date of Patent: May 23, 2006

(54) MANUFACTURED CHIMNEY CAP

(76) Inventor: Luciano Pardini, 19 Maryland La., Tinton Falls, NJ (US) 07724

( * ) Notice: Subject to any disclaimer, the term of this patent is extended or adjusted under 35 U.S.C. 154(b) by 205 days.

(21) Appl. No.: 10/661,840

(22) Filed: Sep. 15, 2003

(65) Prior Publication Data

US 2005/0059335 A1 Mar. 17, 2005

(51) Int. Cl.
*F23J 13/08* (2006.01)

(52) U.S. Cl. ..... 454/4; 454/13; 52/199

(58) Field of Classification Search ..... 454/4, 454/10, 12; 52/198, 199
See application file for complete search history.

(56) References Cited

U.S. PATENT DOCUMENTS 377,508 A * 2/1888 Wright ..... 454/13
717,696 A * 1/1903 Miller ..... 454/13
2,501,011 A * 3/1950 Lee et al. ..... 454/41
2,632,376 A * 3/1953 Driscoll ..... 454/13
2,635,526 A * 4/1953 Anderson ..... 454/13
4,384,617 A * 5/1983 Mueller ..... 169/57
5,402,613 A * 4/1995 Giumenta et al. ..... 52/244
5,609,522 A * 3/1997 Szwartz ..... 454/7
6,152,817 A * 11/2000 Daniels et al. ..... 454/12

* cited by examiner

*Primary Examiner*—Derek S. Boles
(74) *Attorney, Agent, or Firm*—Charles I. Brodsky

(57) ABSTRACT

A manufactured chimney cap is disclosed which provides a weatherproof long lasting enclosure that is designed in such a way so as to divert water away from a centrally integrated chimney flu and off of the chimney cap itself, being encased in a decorative weather-proof material such a aluminum siding, and which is easily installable by one contractor of ordinary skill in a short period of time.

7 Claims, 2 Drawing Sheets

MANUFACTURED CHIMNEY CAP

BACKGROUND OF THE INVENTION

1. Field of the Invention

This invention relates to new construction of chimneys and to the repair of worn chimneys and, more particularly, to the use of a single pre-fabricated chimney cap which is both structurally and decoratively completed prior to installation. The fact that the cap is completed at the factory will be seen to eliminate the need to employ the services of multiple contractors to come to a job site to do their respective work in constructing the finished chimney cap—framers, roofers, siders, metal workers, etc.

2. Description of the Related Art

As is well known in the construction industry, due to the cost, space constraints, structural support, and time constraints, chimneys are very rarely constructed of bricks and mortar. Instead, chimneys are typically no more than a box constructed of plywood which encompasses a metal flu pipe protruding through the roof-top. In construction, a framer first erects a wooden frame around the opening for the flu pipe which protrudes through the roof. A second contractor then wraps the box in plywood, while a plumber installs the flu pipe itself. Once the pipe is installed additional framing and sheeting is assembled to create a chimney cap enclosing and supporting the pipe. Next, siders and roofers are employed to install aluminum or vinyl siding and/or roofing shingles around the box in an attempt to seal out the elements and to make the chimney aesthetically pleasing. Because many different contractors are needed to build a single chimney, and because many chimneys are being erected by them simultaneously, the fit, finish and weather resistance of each chimney usually suffers in quality. For example, the time and attention needed is oftentimes not given to the proper construction of the chimney cap, in pitching it outwardly so as to divert rain water away, but instead permits the water to accumulate, staining, corroding and rotting the exposed materials. In addition, as the exterior fascia is nailed/screwed into place, through the waterproof exterior, rain water frequently leaks through the holes, rotting out the interior wood support.

Because of the high costs, homeowners who have their chimney cap replaced due to the above leaks, corrosion, and rotting, typically do not replace the flu pipe itself, resulting in diminished aesthetics as new materials will then butt up against old. As will be appreciated, to replace the flue is a very expensive project, especially when the process needs to be repeated on a 5 year basis—that being the estimated time before replacement is needed once again. Because the replacement chimney cap is built around the existing flu, caulking, storm collars and siding are employed to try to prevent leakage around the pipe. However, as the metal pipe is constantly expanding and contracting, a break in the seal is almost certain to happen within 5 years, permitting water to leak into the vulnerable interior of the chimney and causing the wood to rot—and the eventual need for replacement once again.

SUMMARY OF THE INVENTION

As will become clear from the following description of the present invention, a new and improved method of constructing chimney caps is described, creating a preconstructed cap which should in theory last as long as the home is occupied by the homeowner.

As will also be seen, the invention accomplishes this in a manner which significantly shortens the time required to complete the chimney installation, and the number of contractors needed.

Thus, and in accordance with the invention, a chimney cap is constructed off site at a factory, either by hand or employing an automated robotic assembly line so as to be uniformly assembled for both aesthetic desirability and weather resistance that would otherwise be impossible to achieve on the job site as will be described, the cap is composed of a wood frame mated to a steel top having an integral flu pipe. The steel top is pitched outwardly from the pipe so as to rain water, leaves, and snow off the chimney cap, thereby reducing the possibility of water seeping into the infrastructure of the chimney. In addition, the desired fascia material and color are applied off-site, and sealed with multiple layers of caulking in a temperature and moisture controlled environment so as to adhere to the manufacturer's curing requirements.

BRIEF DESCRIPTION OF THE DRAWINGS

These and other features of the invention will be more clearly understood from a consideration of the following description, taken in connection with the accompanying drawing in which.

DETAILED DESCRIPTION OF THE INVENTION

Figure 1:
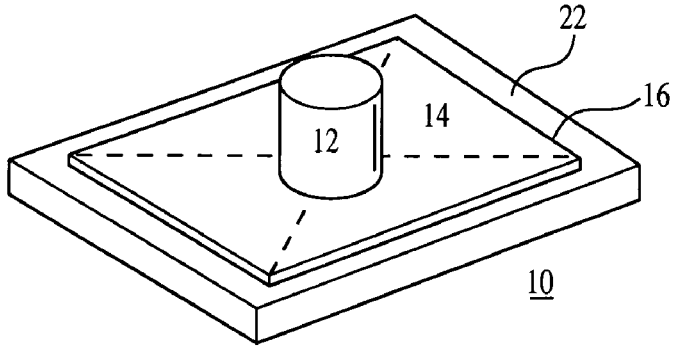
FIG. 1 is a top perspective drawing showing the integrated flu pipe extending from the center of the tapered metal top of the chimney cap of the invention.
Figure 2:
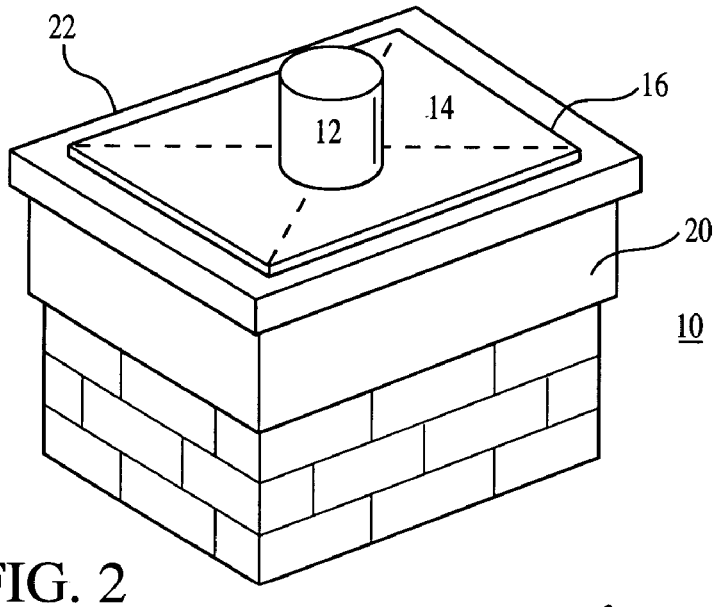
FIG. 2 is a side perspective drawing of the invention as it would appear when installed, showing the overhanging lower portion of the cap snugly fit over the chimney in a manner that prevents water seepage.

As will be understood from FIG. 1, the top view of an assembled chimney cap 10 according to the invention shows a stainless steel integrated flu pipe 12 extending upward from the pitched top plate 14. The integrated flu pipe 12 is secured to the top plate 14 by adhesive, caulking, welding, or a combination thereof. No screws or other piercing means are employed as this would result in the formation of openings due to the expansion and contraction of metal caused by temperature change. When the chimney cap 10 is installed as in FIG. 2, the integrated flu pipe 12 mates with the flu pipe that extends from the chimney box itself. The top plate 14 is formed from a single piece of metal so that it pitches downwardly from the center hole out to its outer lipped edges 16.

Figure 3:
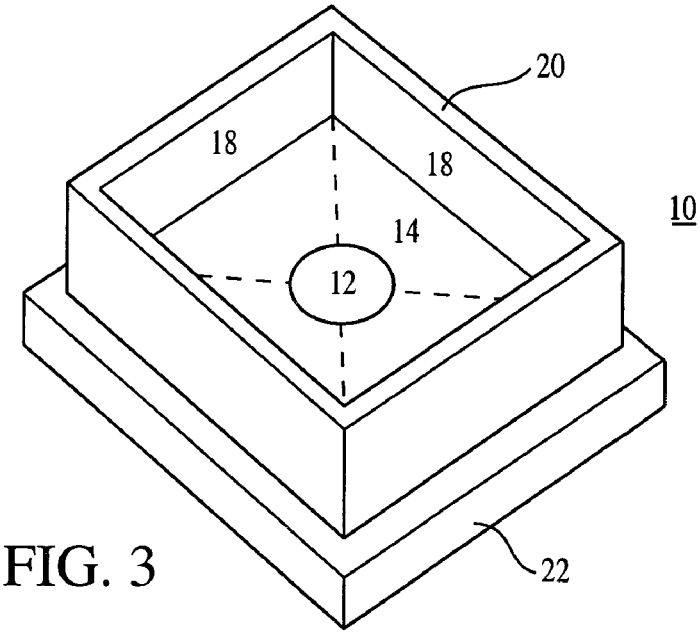
FIG. 3 is a bottom perspective of the invention showing the underlying wooden structure and the bottom of the pitched metal top with the integrated flu pipe.
Figure 4:
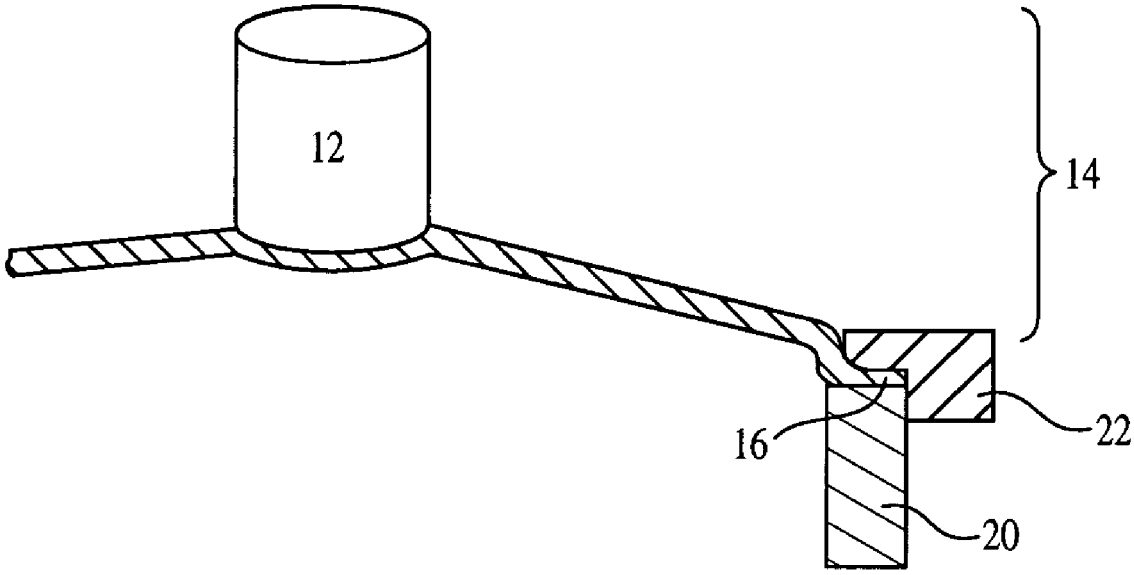
FIG. 4 is a cross section of the metal top showing the pitch, and a lip that extends from its bottom as it would appear when installed in the chimney cap.

FIG. 3 depicts an embodiment of the invention, in which 2×6 pressure treated lumber 18 is used to create the cap frame 20. The top plate 14 is then secured to the top of the cap frame 20 along its outer lipped edges 16.(See FIG. 4) A top rim 22—having an inner dimension substantially similar to the outer dimension of the cap frame 20—also constructed out of pressure treated lumber, is then secured over the outer lipped edges 16 to the cap frame 20. The overlapping of the top rim 22 and the outer lipped edge 16 to cooperate to create a tight compressed fit that on its own prevents most of the elements from penetrating the cap 10.

The desired material—aluminum/vinyl siding or fiberglass, for example—is then applied around the cap frame 20 and to the top rim 22, thereby protecting the framing from exposure to the elements and achieving the desired aesthetic effect. A small seam remains between the encased top rim 22 and the top plate 14 over the outer lipped edge 16. To complete the sealing of the chimney cap 10 to the elements a suitable 50 year solar protected caulking is applied along this seam in a process which ensures longevity and weather resistance.

When a builder is planning the construction of the home, with the invention he may now merely place an order for a pre-manufactured chimney cap of a specific dimension and finish—which can be installed at the job site in a matter of minutes. This is important because scheduling conflicts, inclement weather, etc otherwise often causes the construction and installation of the chimney cap to take several days or even weeks to complete. This can lead to water entering the chimney in the meantime, causing damage or delaying the occupancy of the home and increasing its carrying costs.

While there has been described what is considered to be a preferred embodiment of the present invention, it would be readily appreciated by those skilled in the art that modifications can be made without departing from the scope of the teachings herein. For example, which utilizing pressure treated wood for the framing is described, it will be understood that other materials might be employed which are just as strong and long lasting. For at least such reason, therefore, resort should be had to the claims annexed hereto for a true understanding of the scope of the invention.

I claim:

1. A manufactured chimney cap for installation at a house over a vinyl chimney and its circular flue pipe comprising:

a wooden frame dimensioned to fit about the vinyl chimney;

a top plate upwardly extending from the frame;

an aperture in said top plate to receive the circular flue pipe of the chimney; and an extension pipe upwardly extending from said top plate at said aperture dimensioned to wrap around the flue pipe when protruding therethrough;

with said top plate and said extension pipe being composed of stainless steel;

with said wooden frame being clad in aluminum;

wherein said top plate is downwardly pitched from said aperture towards outer lipped edges thereof; and wherein the outer lipped edges of said top plate are set beneath said frame at a top rim thereof.

2. The manufactured chimney cap of claim 1 wherein said wooden frame is clad in colored aluminum.

3. The manufactured chimney cap of claim 1 wherein said wooden frame is clad in aluminum colored to match the color of the house.

4. The manufactured chimney cap of claim 1 wherein said wooden frame is dimensioned to snugly fit about the vinyl chimney.

5. The manufactured chimney cap of claim 4 wherein said wooden frame is composed of pressure treated lumber.

6. The manufactured chimney cap of claim 1, also including a long life caulking at a join formed between said outer lipped edges and said top rim.

7. The manufactured chimney cap of claim 6 wherein said extension pipe is secured with said top plate by one of aluminum, caulking, or welding, or a combination thereof.

* * * * *